US008267153B2

(12) United States Patent
Hoffmeister et al.

(10) Patent No.: US 8,267,153 B2
(45) Date of Patent: Sep. 18, 2012

(54) CONTINUOUS CASTING MOLD

(75) Inventors: Jörn Hoffmeister, Moers (DE); Michael Dreis, Duisburg (DE); Ulrich Snadny, Oer-Erkenschwick (DE)

(73) Assignee: SMS Siemag Aktiengesellschaft, Düsseldorf (DE)

( * ) Notice: Subject to any disclaimer, the term of this patent is extended or adjusted under 35 U.S.C. 154(b) by 0 days.

(21) Appl. No.: 13/120,560

(22) PCT Filed: Sep. 21, 2009

(86) PCT No.: PCT/EP2009/006788
§ 371 (c)(1),
(2), (4) Date: Jul. 6, 2011

(87) PCT Pub. No.: WO2010/034444

PCT Pub. Date: Apr. 1, 2010

(65) Prior Publication Data

US 2011/0259543 A1 Oct. 27, 2011

(30) Foreign Application Priority Data

Sep. 23, 2008 (DE) ..... 10 2008 048 488
Nov. 18, 2008 (DE) ..... 10 2008 057 888

(51) Int. Cl.
*B22D 11/04* (2006.01)
*B22D 11/05* (2006.01)

(52) U.S. Cl. ..... 164/436; 164/491

(58) Field of Classification Search ..... 164/436, 164/491
See application file for complete search history.

(56) References Cited

U.S. PATENT DOCUMENTS 4,223,717 A 9/1980 Scheurecker
4,523,623 A * 6/1985 Holleis et al. ..... 164/436
4,960,165 A 10/1990 Eidinger et al.
5,249,622 A * 10/1993 Dalimonte ..... 164/491
5,307,862 A * 5/1994 Sakata et al. ..... 164/436
5,322,112 A * 6/1994 Sakata ..... 164/436
5,333,671 A 8/1994 Sera et al.
6,145,580 A * 11/2000 Lamberti et al. ..... 164/418
6,585,029 B1 7/2003 Flick et al.
6,973,957 B2 12/2005 Naito

FOREIGN PATENT DOCUMENTS

DE 2926719 1/1980
DE 3838010 5/1990
EP 1057556 12/2000
EP 1140389 7/2002

* cited by examiner

*Primary Examiner* — Kevin P Kerns
(74) *Attorney, Agent, or Firm* — Lucas & Mercanti, LLP; Klaus P. Stoffel

(57) ABSTRACT

A continuous casting mold for the continuous casting of a metal strand, particularly a steel strand, comprising mutually opposing wide side walls and mutually opposing narrow side walls which are disposed in a clamped manner between the wide side walls and can be displaced along the wide side walls transversely to the casting direction and taper in a wedge-shaped manner in the casting direction, wherein the wide side walls comprise a funnel-shaped pouring region extending in the casting direction to the mold end, and wherein the narrow side walls are disposed in an exchangeable manner according to the thickness to be set for the metal strand to be cast, and wherein the positions of the narrow sides can be set by means of a narrow side adjustment system (7) having an upper and an lower adjustment device (8, 9) in relation to the center line (11) of the metal strand to be cast, characterized in that the narrow side adjustment system (7) comprises at least one control element (12, 13), which acts on the adjustment devices (8, 9) at least substantially transversely to the center line, and an alignment device for aligning the positions of the upper and lower control devices in relation to a specified reference position which are set by the at least one control element (12, 13).

13 Claims, 3 Drawing Sheets

CONTINUOUS CASTING MOLD

The present application is a 371 of International application PCT/EP2009/006788 filed Sep. 21, 2009, which claims priority of DE 10 2008 048 488.1, filed Sep. 23, 2008, and DE 10 2008 057 888.6, filed Nov. 18, 2008, the priority of these applications is hereby claimed and these applications are incorporated herein by reference.

BACKGROUND OF THE INVENTION

The invention concerns a continuous casting mold for the continuous casting of a metal strand, especially a steel strand, with opposite broad-side walls and with opposite narrow-side walls, which are arranged in such a way that they can be clamped between the broad-side walls and can be displaced along the broad-side wane transversely to the direction of casting and which taper in wedge-like fashion in the direction of casting, wherein the broad-side walls have a funnel-shaped pouring region, which extends to the end of the mold in the direction of casting, wherein the narrow-side walls are interchangeably arranged according to the thickness to be set for the metal strand to be cast, and wherein the positions of the narrow sides can each be adjusted, with respect to the center axis of the metal strand to be cast, by means of a narrow-side adjustment system that comprises an upper and a lower adjusting device.

Especially in the recent past, in the production of metal strands, especially steel slabs, there has been an increasing trend towards the use of slab molds whose dimensions can be varied according to the desired width and height of the steel strand. In this connection, the width of the steel strand can be adjusted by varying the distance between the two narrow sides. If the thickness of the slab is to be varied, this requires that preferably one of the broad sides of the casting mold be designed as a movable side and adjusted relative to the stationary side. Correspondingly, narrow sides with a different format must be clamped in between the broad sides. This is known, for example, from U.S. Pat. No. 6,973,957.

Depending on the width of the necessary narrow-side plate element, this must be operated by a control device to move it towards the center of the mold or in the opposite direction according to the width of the slab to be cast. The control device comprises an upper and a lower adjusting element to make it possible to squeeze the side wall downward between the two broad sides according to the necessary inclination of the mold center. In this connection, if the control device does not act at least essentially centrally on the side wall, lateral tilting moments are exerted on the side wall, which take the side wall out of the desired position and cause damage.

The center axis of the narrow-side adjustment system is aligned on the center position of the given casting thickness in a well-known way in the workshop with the aid of screwed connections that are arranged parallel to the center axis. In this regard, the narrow-side wall is fixed between the broad sides by frictional engagement in the clamping joint. However, there are also embodiments in which the adjusting device cannot be brought to the given center axis of the side wall, because the guide tubes of the control device are permanently welded in the frame of the mold.

To adjust the mold to a new casting thickness, the parts of the frame of the mold often must be broken down into their individual parts, or individual water tanks are removed. When a new casting thickness is to be adjusted, it is always necessary to exchange parts, including, for example, water-conveying elements, which in many cases do not have the mobility that would be required to allow compensation of the displacements of the water tank of the movable side that result from the change in the thickness of the slab.

All together, the assembly and alignment work involved in the adjustment of the position of the center axis proves to be very time-consuming. The adjustment and exact alignment often require complicated measurement and alignment of pistons moving in cylinders or guide pins of the adjustment system among themselves and relative to the theoretical stationery-side reference plane. This also requires that many replaceable parts be kept on hand for different casting thicknesses. When a change in casting thickness is made, it is often necessary to install and later uninstall bellows expansion joints for compensating differences in path length as well as assigned parts that depend on casting thickness. To achieve ideal adjustment of the center of the narrow-side adjustment system, it is even necessary under certain circumstances to uninstall and later reinstall the water tanks on the movable side.

SUMMARY OF THE INVENTION

The objective of the invention is to improve a continuous casting mold in such a way that the position of the center axis of a narrow-side adjustment system for molds with different casting thicknesses can be adjusted in a simple way to the given ideal position of the center axis for the given thickness format of a slab.

In regard to a continuous casting mold of the aforementioned type, the solution to this problem is characterized in that the narrow-side adjustment system has at least one control element, which acts in common on the adjusting devices at least essentially transversely to the center axis, and an alignment device for aligning the positions of the upper and lower control devices with respect to a specified reference position, which positions are adjusted by the one or more control elements. The use of the invention makes it possible to convert molds to a new casting format mite quickly than is the case with conventional methods. Due to the good accessibility of the control elements, the water tank on the movable side does not have to be uninstalled. A continuous casting mold equipped with the narrow-side adjustment system is subject to less risk of misalignment by pushing or pulling on machined reference surfaces or by, a position measuring device integrated in the control element or the control device.

Advantageous modifications of the invention are disclosed in the dependent claims.

An advantageous provision of the invention is that the alignment device comprises connecting means and/or a format piece for producing a connection to at least one mechanical reference surface or for setting to an exact reference position for establishing the casting thickness.

In an advantageous modification, the control elements comprise two hydraulically or pneumatically operated cylinders arranged transversely to the center axis and/or drives operated by electric motor, especially spindle drives.

Preferably, the cylinders and/or the electric drives can be operated under automatic position control.

It can also be provided that the control elements comprise cup spring units and hydraulic plunger cylinders. In the case of manual setting, the control elements form a screw system, in which the positions of the screws can be fixed by counter nuts.

It is advantageous if the control elements are formed sufficiently long that they are accessible from the outside of the continuous casting mold.

In another advantageous refinement of the invention, it is provided that a displaceable water tank arranged on the movable broad side is at least partially integrated in a lateral frame region formed by the continuous casting mold by a water-conveying element that receives the water tank's displacement and is arranged in the lateral frame region and supported there and/or that the displaceable water tank is freely arranged above a cheek of the continuous casting mold.

It is advantageous if the water-conveying element comprises a lateral bellows expansion joint and/or a hose, especially in conjunction with a rigid length of pipe, where especially the ends of the length of pipe are spherically formed, especially in conjunction with sealing elements that provide a radial seal. Moreover, this system also requires fewer special steel plate parts compared to the prior art.

The invention will now be explained in greater detail on the basis of a specific embodiment.

DETAILED DESCRIPTION OF THE INVENTION

Figure 1:
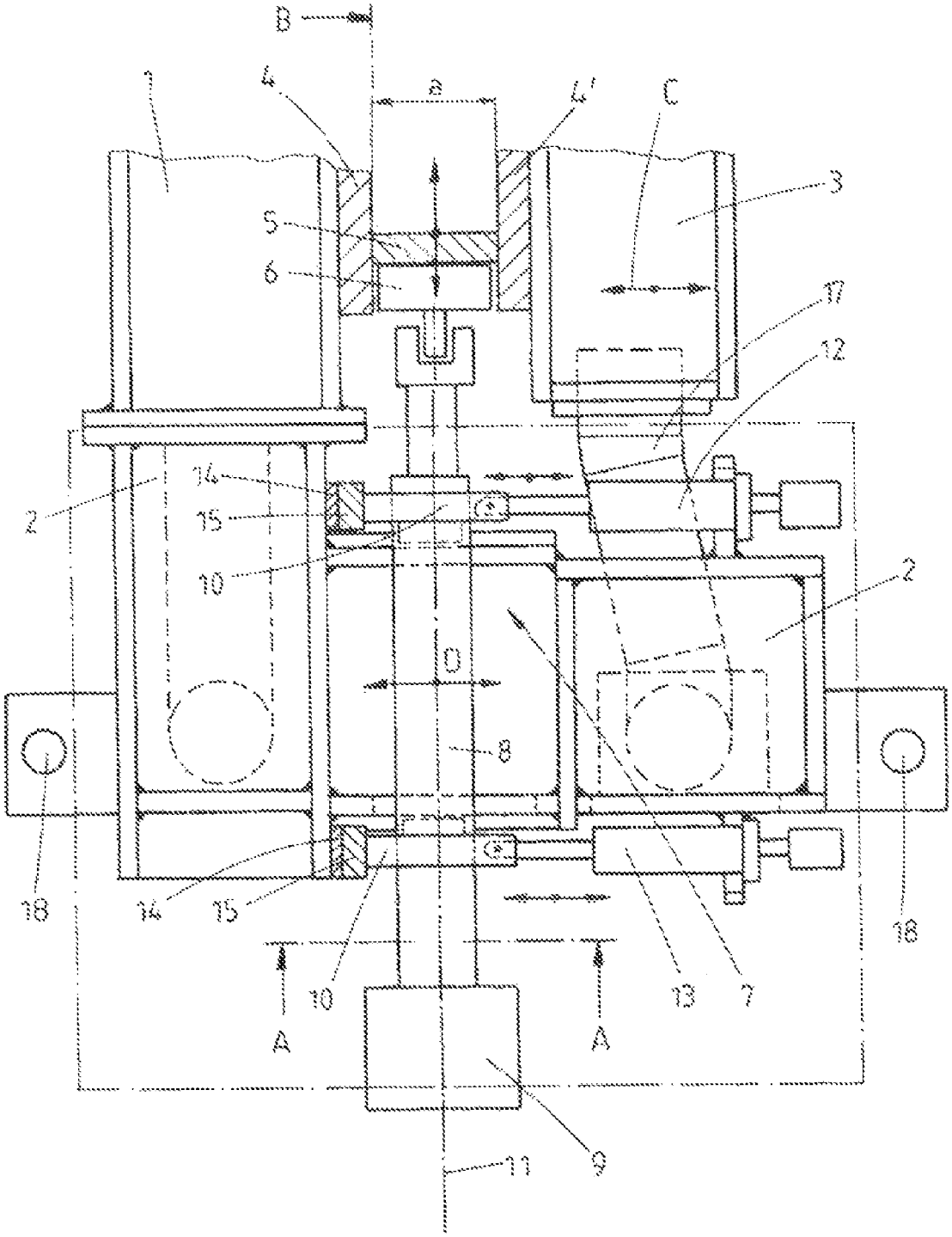
FIG. 1 is a partial sectional top view of a lateral region of a continuous casting mold.

A continuous casting mold (FIGS. 1 to 3) for the continuous casting of a steel strand in the direction of arrow B (after deflection, for example, by 90°) comprises a support frame 1 for a stationary broad-side part, a support frame 2 for each of the two narrow-side parts, and a support frame 3 for the movable broad-side part (movable side).

The support frame 1 supports a copper plate 4, which forms the stationary broad side of the pouring funnel. Copper plates 5 belonging to the respective narrow-side parts 1 2 are arranged on the narrow sides. Each copper plate 5 is mounted on a beam 6. The illustrated copper plate 5 corresponds to a selected casting thickness a. The support frame 3 supports a copper plate 4.

A narrow-side adjustment system 7 is present, which preferably comprises an upper adjusting element 8 and a lower adjusting element 9 located beneath it. These two adjusting elements 8, 9 serve to adjust the width of the cast strand, i.e., to move the copper plate 4' in the direction of arrow C, and at the same time to maintain the inclination of the copper plate 5 necessary to form the pouring funnel.

Figure 2:
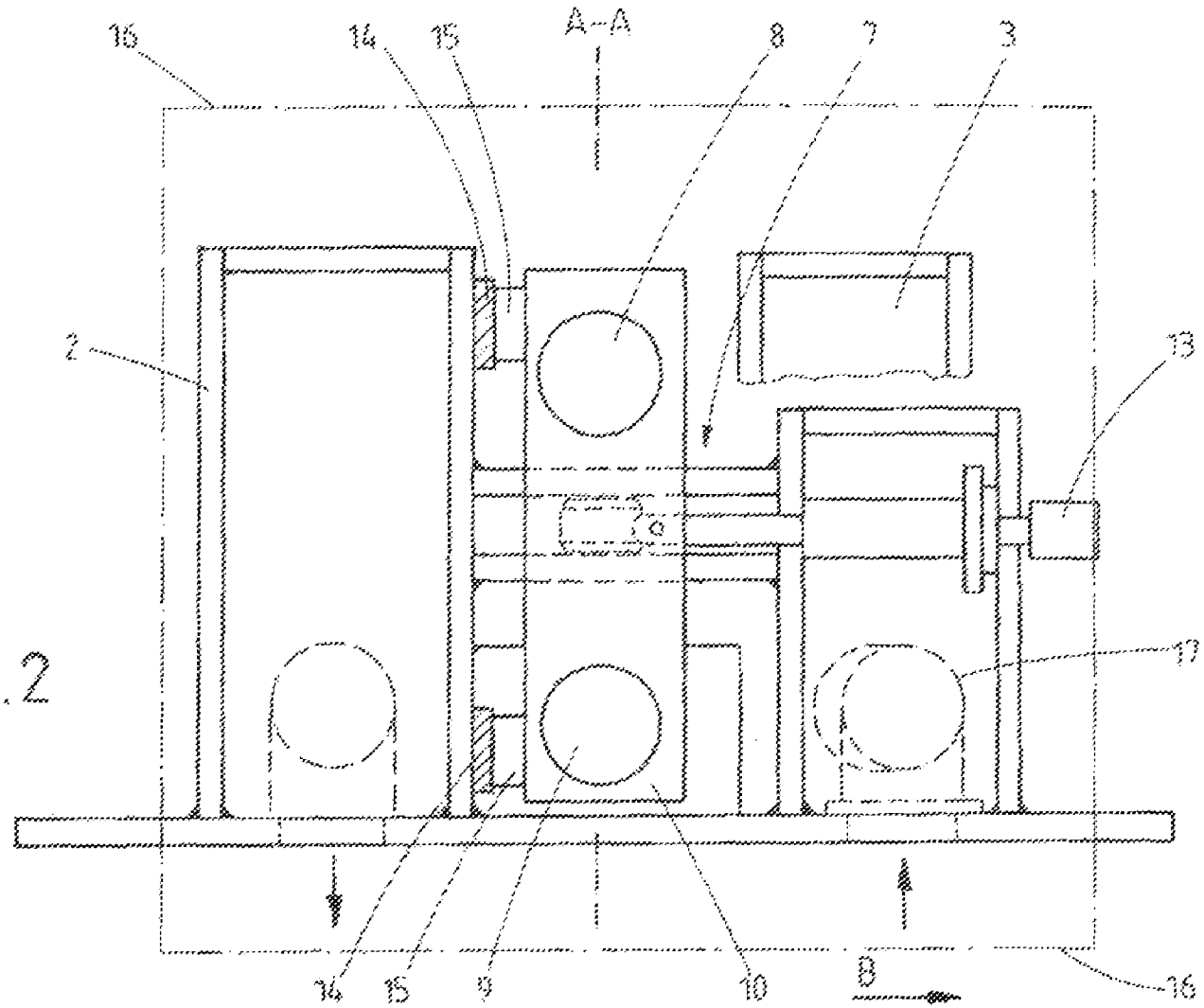
FIG. 2 is a sectional view of the narrow-side lateral region of the continuous casting mold of FIG. 1 along sectional plane A-A.
Figure 3:
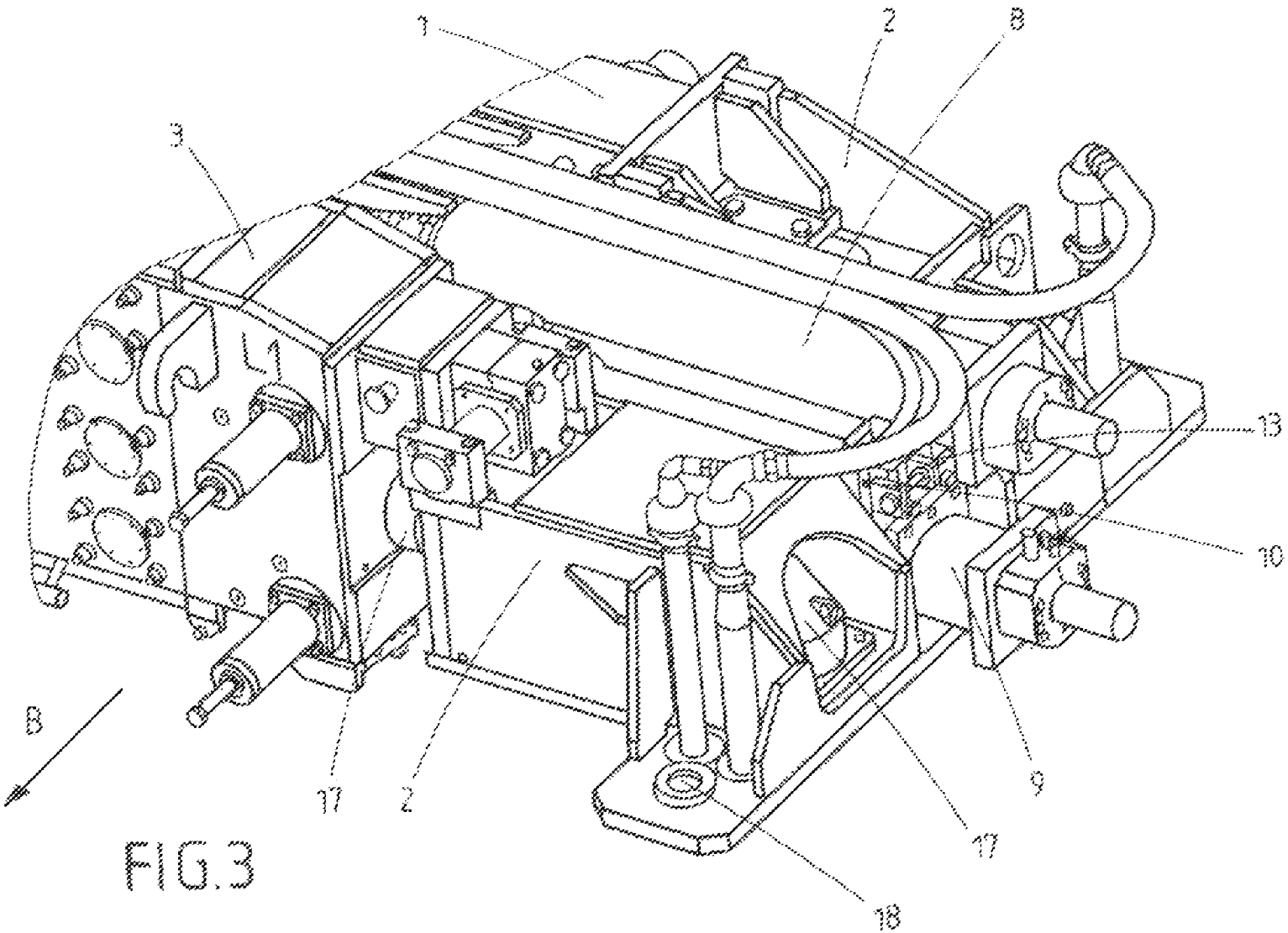
FIG. 3 is a perspective view of the lateral region of the continuous casting mold.

To allow synchronous adjustment that preserves the inclination of the copper plate 5, the adjusting element 8 and the adjusting element 9 located below it are coupled with each other by a connecting part 10 (FIG. 2). To increase the stability, there are preferably two sets of adjusting elements 8, 9. If, after the exchange of copper plate 5 for a copper plate of a different width a', the position of a center axis 11 of the narrow-side adjustment system changes, displacement in the direction of arrow D is carried out on the entire system by simultaneous adjustment of control elements 12, 13, which is oriented in one direction or the opposite direction according to the change in thickness of the slab. In this regard, the control elements 12, 13 are each supported on the connecting parts 10 by stops or reference marks 14.

The control elements 12, 13 each comprise hydraulic or pneumatic cylinders or have a threaded spindle operated by an electric motor. The control elements 12, 13 preferably also have displacement pickups or are equipped with other means for detecting distances and/or positions and for suitably controlling an adjusting element. The control elements 12, 13 adjust each of the narrow sides 2 relative to the reference marks 14. In addition, format pieces 15 that depend on the casting thickness can be used to facilitate alignment. The reference marks 14 and the format pieces 15 together constitute an alignment device or are part of an alignment device.

The entire narrow-side adjustment system 7 is preferably integrated in a lateral frame region 16, which extends to the side of the casting mold and does not extend beyond the front edge of the support frame 1, i.e., the edge in the casting direction, or at least does not extend substantially beyond it. In connection with the displaceability of the control elements 12, 13, a water-conveying element 17 can also be moved together with them, which offers the necessary mobility to be able to compensate the displacements of the water tank of the movable side that result from the differences in casting thickness. The water-conveying element 17 comprises a lateral bellows expansion joint and a movable hose, for example, also in conjunction with a rigid length of pipe. In this regard, spherically shaped ends can be provided on the connecting elements in conjunction with sealing elements that provide a radial seal. O rings, for example, can be used as the sealing elements. This gives the lengths of pipe, for example, a "dog bone shape".

The mold is supported on a lift system by fixation points 18.

The invention claimed is:

1. A continuous casting mold for continuous casting of a metal strand, comprising:

opposite broad-side walls;

opposite narrow-side walls arranged so as to be clampable between the broad-side walls and displaceable, along the broad-side walls transversely to a direction of casting, the narrow-side walls tapering in wedge-like manner in a direction of casting, wherein the broad-side walls have a funnel-shaped pouring region that extends to an end of the mold in the direction of casting, wherein the narrow-side walls are interchangeably arranged according to a thickness to be set for the metal strand to be cast; and a narrow-side adjustment system for adjusting positions of the narrow-side walls laterally with respect to a center axis of the metal strand to be cast, the narrow-side adjustment system including an upper adjusting device and a lower adjusting device, wherein the adjusting devices each actively effect only adjustments of the narrow-side wall, the narrow-side adjustment system further including at least one control element that acts in common on the adjusting devices transversely to the center axis, and an alignment device for aligning positions of the upper and lower control devices with respect to a specified reference position, which positions are adjusted by the at least one control element.

2. The continuous casting mold in accordance with claim 1, wherein the alignment device includes connecting means and/or a format piece for producing a connection to at least one mechanical reference surface or for adjusting to an exact reference position.

3. The continuous casting mold in accordance with claim 1, wherein the at least one control element includes two hydraulically or pneumatically operated cylinders arranged transversely to the center axis and/or drives operated by electric motor, especially worm drives.

4. The continuous casting mold in accordance with claim 3, wherein the drives are worm drives.

5. The continuous casting mold in accordance with claim 3, wherein the cylinders and/or the electric drives are operable under automatic position control.

6. The continuous casting mold in accordance with claim 3, wherein the at least one control element includes cup spring units and hydraulic plunger cylinders.

7. The continuous casting mold in accordance with claim 1, wherein the control elements form a screw system, in which positions of the screws are fixable by counter nuts.

8. The continuous casting mold in accordance with claim 7, wherein the control elements are externally accessible from outside of the continuous casting mold.

9. The continuous casting mold in accordance with claim 1, and further comprising a displaceable water tank arranged on the movable broad side and at least partially integrated in a lateral frame region formed by the continuous casting mold by a water-conveying element that receives displacement of the water tank and/or the displaceable water tank is freely arranged above a cheek of the continuous casting mold.

10. The continuous casting mold in accordance with claim 9, wherein the water-conveying element includes a lateral bellows expansion joint and/or a hose.

11. The continuous casting mold in accordance with claim 10, further comprising a rigid length of pipe in conjunction with the lateral bellows expansion joint and/or the hose.

12. The continuous casting mold in accordance with claim 10, wherein the length of pipe has spherically formed ends.

13. The continuous casting mold in accordance with claim 12, further comprising sealing elements on the ends of the length of pipe so as to provide a radial seal.

* * * * *